US005580021A

United States Patent [19]

Gillanders

[11] Patent Number: 5,580,021

[45] Date of Patent: Dec. 3, 1996

[54] POWER TOOL SUSPENSION MECHANISM WITH MOMENTARY TENSION RELIEVING DEVICE

[76] Inventor: David D. Gillanders, 1969 Chevy Chase Dr., Brea, Calif. 92621

[21] Appl. No.: 440,890

[22] Filed: May 15, 1995

[51] Int. Cl.[6] ..... B25B 29/00

[52] U.S. Cl. ..... 248/330.1; 248/52; 248/550; 248/579; 248/585; 74/89.17; 74/89.22; 81/57.4

[58] Field of Search ..... 248/330.1, 579, 248/550, 52, 329, 585; 81/57.4, 54, 52; 30/379.5, 298.4; 83/639.1; 173/147; 408/234; 74/89.17, 89.22; 242/382, 384.7, 390.5, 391.2

[56] References Cited

U.S. PATENT DOCUMENTS

| | | | |
|---|---|---|---|
| 1,163,444 | 12/1915 | Newell | 242/384.7 X |
| 2,179,316 | 11/1939 | Anderson | 173/147 |
| 2,471,793 | 5/1949 | Stull | 81/57.4 X |
| 2,939,680 | 6/1960 | Powell | 242/390.5 X |
| 3,016,774 | 1/1962 | Minobe | 81/54 |
| 3,333,613 | 8/1967 | Bosse | 81/57.4 |
| 3,666,220 | 5/1972 | Rider | 248/52 |
| 3,694,888 | 10/1972 | Bosse | 81/57.4 X |
| 3,910,325 | 10/1975 | Dixon | 81/57.4 X |
| 4,116,748 | 9/1978 | Lass | 156/526 |
| 4,523,498 | 6/1985 | Chapman, Jr. | 81/117.1 |
| 4,556,184 | 12/1985 | O'Sullivan | 248/330.1 |
| 4,782,726 | 11/1988 | Ryder et al. | 81/57.4 |
| 5,109,736 | 5/1992 | Dixon | 81/57.4 |
| 5,213,292 | 5/1993 | Evans | 248/123.1 |
| 5,367,924 | 11/1994 | Henson et al. | 81/57.4 |

FOREIGN PATENT DOCUMENTS

| | | | |
|---|---|---|---|
| 8700840 | 11/1988 | Netherlands | 242/384.7 |

*Primary Examiner*—Wynn E. Wood
*Assistant Examiner*—Laura A. Saladino

[57] ABSTRACT

A suspension mechanism for a manually manipulated power tool which, upon actuation of the power tool momentarily relieves the tension supporting the power tool and enables the power tool's weight to be utilized to augment the axial force required to perform work such as screwdriving, drilling and grinding. A sensor mechanism which is part of the invention may also be used to obtain similar benefits from prior art suspension mechanisms.

2 Claims, 1 Drawing Sheet

POWER TOOL SUSPENSION MECHANISM WITH MOMENTARY TENSION RELIEVING DEVICE

BACKGROUND

1. Field of Invention

The invention described herein relates to suspension mechanism used to support and suspend the weight of small, manually manipulated power tools.

2. Description of Prior Art

Mechanisms used to support and suspend small, manually manipulated power tools are provided in several forms. One design, commonly referred to as a tool balancer, consists of a cable wound around a reel which is connected to an adjustable, flat, wound spring which resists the cable's withdrawal from the reel. The free end of the cable is attached to the tool, and the reel is attached to a support means above the work area. The objective is to provide a weightless condition for the tool, wherein an operator may move the tool to a workpiece and altemately up and out of the way of a workpiece to enable a workpiece to be moved in the case of a conveyor line, or to facilitate other operations to be preformed on a workpiece, with relative ease as compared to an unsuspended tool. Another design, less common, but the most simplistic in structure, is a cable attached at one end to the power tool and the other end to a counterweight with an intermediary pulley or pulleys to direct the cable appropriately. Finally, some designs utilize articulated arms linked in a parallelogram or other arrangements in an effort to maintain the tool's angular relationship to the workpiece at varying heights and lateral locations. These mechanisms use either coiled springs which may be tension-adjusted or air cylinders with adjustable pressure regulators to provide the countering force to support the power tool. Power tools vary considerably in weight so it is necessary to have some degree of adjustability. All of the aforementioned designs have merit in the function of counterbalancing a power tool's weight and reducing the necessary effort by the operator to move the tool to the subject workpiece, and to position the tool in a location above and out of the way of the work area. In many applications of power tools, however, a commonly downward, axial force is necessary to perform the desired work, especially in the cases of screwdriving and drilling. The function of the discussed suspension mechanism necessitate that the operator of the power tool supply all of the required downward force. Furthermore, in actual practice, suspension mechanisms are often adjusted to the subject power tool, in order that the tool will refract away from the workpiece when released by the operator. This condition necessitates an even greater amount of downward pressure to by provided by the human operator. The continual repeated application of axial force by the operator results in fatigue, exposure and susceptibility to a variety of cumulative disorders and repetitive motion injuries. The power tool itself, however, possesses a fixed mount of mass which, if utilized, could provide all or part of the required axial force. The utilization of the mass, to be beneficial, could occur only during the actual work cycle of the power tool, so that at all other times, the power tool would by suspended. It would be a great advantage to an operator if a limited, adjustable amount of tension relief could be provided from the suspension mechanism at the instant the tool is actuated, and then revert to the original suspended condition when the work cycle is completed. A device of this type would undoubtedly result in less effort being spent and would consequently result in a reduction in hand, wrist, arm, and elbow injuries, which are commonplace among operators performing this type of work. A hypothetical scenario is a size ten wood screw being installed into door frames at the rate of 5,000 per day. The application requires an axial force of approximately five pound& to drive the screw into the wood. The weight of the tool is three pound&. An additional one pound negative force is created by the suspension device. Utilizing a tension relieving suspension mechanism would provide four of the required five pound& of force to drive the screw. In the course of one workday, a net savings of twenty thousand pound& of effort would be realized by the operator of the power tool in this example. Furthermore, common applications require lateral movements of the power tool to reach various locations of the subject workpiece. Quite often, the suspension mechanism is rigidly mounted above the workpiece and consequently does not follow the power tool laterally through its movements resulting in lateral resistance to movement of the tool. This causes more effort to by expended by the operator and less accurate positioning and performance from the power tool. A tension relief device which is activated at the moment the tool is actuated would greatly improve the use of the power tool and eliminate the lateral force against the desired position of the power tool and thereby greatly reduce fatigue in the power tool operator.

OBJECTS AND ADVANTAGES

Accordingly, several objects and advantages of the present invention are:

(a) To provide a power tool suspension mechanism with a momentary tension relieving device which will utilize the inherent weight of a power tool to provide all or part of the required axial force to perform a particular operation. The tension relieving action will be activated only during the use of the power tool, and at all other times will provide suspension and support for the power tool (b) To provide a power tool suspension mechanism with a momentary tension relieving device which will enable a power tool, such as a grinder, to be moved more freely laterally during its use without resistance from the suspension mechanism.

(c) To provide a mechanism by which to accurately sense a power tool's actuation and to consequently cause the mechanism to momentarily relieve the tension supporting the weight of the power tool, in a predictable and controlled way.

(d) To provide a mechanism by which the aforementioned sensing mechanism could be u fizzed in the case of a suspension arrangement using compressed air as its tensioning medium, to reduce the air pressure, causing momentary relief of the tension.

Further objects and advantages will become apparent from a consideration of the ensuing description and drawings.

DRAWING FIGURES

Figure 3A:
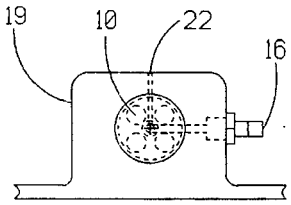
Figure 3B:
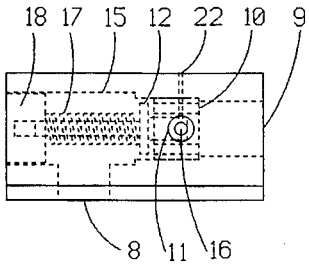

FIG. 3 A and 3 B are enlarged, partial front and side view of the invention showing the pneumatic sensing mechanism.

Figure 4:
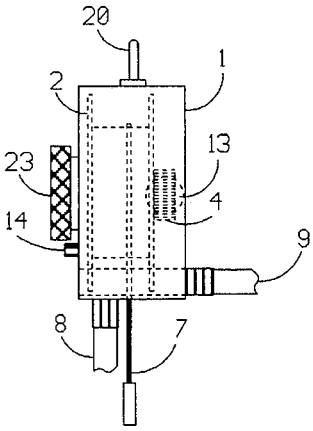

FIG. 4 is a side view of the invention.

Figure 5:
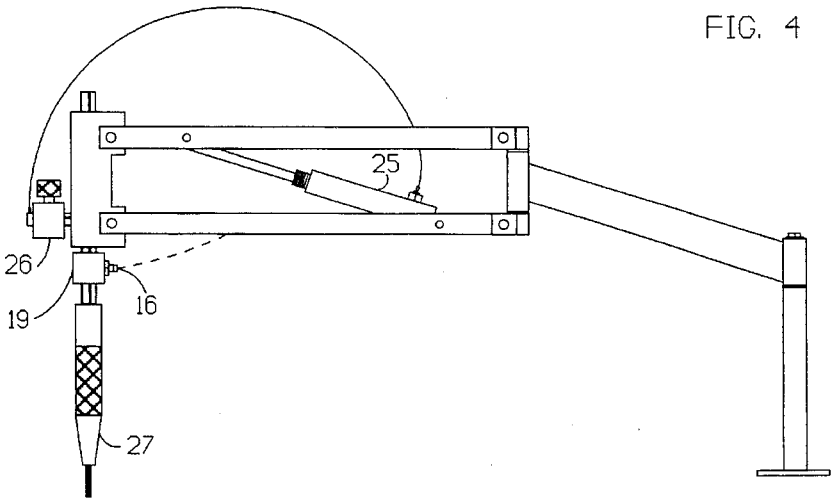

FIG. 5 is a side view of a prior art parallelogram arm compressed air suspension device, which could be used with the pneumatic sensing mechanism portion of the invention to achieve similar results.

| Reference Numerals in Drawings | |
|---|---|
| 1 housing | 15 sensor cylinder |
| 2 spring containment cable drum | 16 sensor output to air cylinder |
| 3 flat wound torsion spring | 17 differential spring |
| 4 pinion gear | 18 guide |
| 5 overrunning clutch | 19 flow sensor valve |
| 6 gear rack | 20 mounting eye |
| 7 suspension cable | 21 air cylinder pivot spring |
| 8 power tool air supply | 22 sensor bleed port |
| 9 air inlet | 23 tension adjustment knob |
| 10 transfer ports | 24 stroke adjustment knob |
| 11 output port | 25 suspension air cylinder |
| 12 piston | 26 air pressure regulator |
| 13 air cylinder | 27 pneumatic power tool |
| 14 flow control | |

DESCRIPTION FIGS. 1, 2, 3, 4, 5

Figure 1:
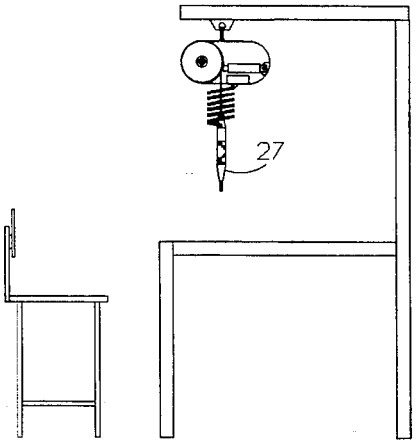
FIG. 1 is a from view of the present invention shown supporting a power tool a typical work station environment. The invention is affixed to an overhead frame member which is typically made a part of the user's work station or conveyor system.
Figure 2:
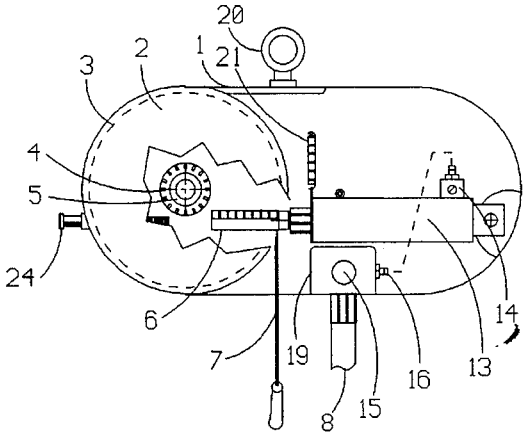
FIG. 2 is a from view of the invention showing the function of the tension relieving mechanism .

A typical embodiment of the power tool suspension mechanism with momentary tension relieving device of the present invention is illustrated in FIG. 1 (front view in work station environment), FIG. 2 (front view), FIG. 3 (enlarged, partial front and side view ), FIG. 4 (side view) and FIG. 5 (side view showing use with prior art suspension device). A homing 1 supports and contains a spring containment cable drum 2, an air cylinder 13, and a flow sensor valve 19. A suspension cable 7 is wound around the drum and a flat wound torsion spring 3 within the drum creates tension which is regulated by the tension adjustment knob 23, employing a conventional ratchet mechanism, in order to suspend the weight of a power tool 27. The housing is attached to an overhead support member by means of a mounting eye 20. An air cylinder 13 receives compressed air from the sensor output 16, which flow is metered by means of the flow control 14, in order to regulate the speed with which the cylinder is actuated. Attached to the air cylinder is a gear rack 6. Limiting the travel of the gear rack is a stroke adjustment knob 24. An air cylinder pivot spring 21 maintains the relative position of the air cylinder. Attached to the drum is a pinon gear 4, within which is an overrunning clutch 5. An air inlet 9 is provided which supplies the power tool air supply 8 and the flow sensor valve 19. The flow sensor valve is comprised of a sensor cylinder 15 which is displaced between the air inlet and power tool air supply ports. Within the sensor cylinder is a fixed output port body through which are transfer ports 10 to allow air flow and an output port 11 which is connected to the sensor output.

Contained in the sensor cylinder is a piston 12, a guide 18, and a differential spring 17. A sensor bleed port 22 connects the sensor output to air cylinder to atmosphere.

OPERATION FIGS. 1, 2, 3, 4, 5

The mounting eye 20 is attached to an overhead support structure. A pneumatic power tool 27 is attached to the suspension cable 7. The flat wound torsion spring 3 is tensioned by rotating the tension adjustment knob 23 in order to support the weight of the pneumatic power tool. The power tool air supply 8 is connected to the power tool typically via a recoil type hose of sufficient length to allow for a range of motion suitable for the specific work station environment. A suitable compressed air supply of sufficient capacity to operate the power tool is connected to the air inlet 9. In this present condition, the power tool is not actuated and therefore is not consuming any compressed air. In this condition the sensor piston 12 is experiencing equal mounts of pressure at both the air inlet 9, and the power tool air supply 8 and no motion of air is preceded by the piston 12. The differential spring 17 causes the piston 12 to press against the output port 11 and thus prevents pressurized air escaping to the air cylinder and the sensor bleed port 22. Upon actuation of the power tool 27, an imbalance of pressure will occur between the tool air supply 8 and the air inlet 9. The flow of air through the transfer ports 10 will cause the piston 12 to move away from the output port 11, while allowing a selected volume of air to flow through the power tool air supply 8. This selected volume is a function of the diametral differences of the piston 12 and it's respective cylinder 15, within the flow sensor valve 19. This condition will result in compressed air also flowing to the sensor output to air cylinder 16, through an adjustable flow control 14 and to the air cylinder 13. Pressure in the air cylinder will cause the cylinder piston rod and simultaneously the gear rack 6 to extend. The speed with which the gear rack extends may be regulated with the adjustable flow control. The gear rack will encounter and engage the pinion gear 4 and cause the spring containment cable drum 2 to rotate in the direction of the power tool, causing the power tool to freely descend. The distance which the gear rack moves and the resultant motion of the spring containment cable drum is adjustable by a threaded limit stop which is controlled by turning the stroke adjustment knob 24. An air cylinder pivot spring 21 maintains pressure on the pinon gear from the gear rack to ensure engagement but still allows for motion should the gear rack and pinion gear not immediately mesh correctly. An oreintoning clutch 5 couples the pinion gear to the spring containment cable drum for the purpose of enabling additional cable to be withdrawn if necessary while the tool is actuated. When the power tool is no longer actuated, the sensor piston 12 returns to the static position, closing off the output port 11. A spring inside the air cylinder causes the piston and the gear rack to retract. The exhaust pressure resulting from the retraction is exhausted to atmosphere through the sensor bleed port 22.

SUMMARY, RAMIFICATIONS, AND SCOPE

Accordingly, the reader will see that the invention is a superior device which has the unique features of:

A support device for a manually manipulated power tool which will, upon actuation of the power tool, momentarily relieve the tension supporting the power tool to enable the power tool's weight to augment the axial force necessary to perform the work which would otherwise be totally supplied by the operator of the power tool operator.

Adjustability of the tension relieving mechanism so that an appropriate amount of tension relief is supplied avoiding an unexpected lack of control of the tool.

Adaptability of the sensing mechanism to be used on pneumatically tensioned prior art tool supports to provide like benefit to the operator.

A power tool suspension mechanism which, when the power tool is not being operated, will provide counterbalanced support for the power tool for the purpose of reducing fatigue in the power tool operator.

A device which offers a completely new and beneficial approach to the long standing problem of supporting hand held power tools and reducing fatigue and strain in human operators of power tools.

Although the description above contains many specifications, these should not be construed as limiting the scope of the invention but as merely providing illustrations of some of the presently preferred embodiments of this invention. Accordingly, the scope of the invention should be determined not by the embodiment(s) illustrated, but by the appended claims and their legal equivalents.

I claim:

1. A power tool suspension mechanism with momentary tension relieving device comprising:

(a) a drum around which a power tool support cable is wound;

(b) an adjustable spring in connection with said drum creating tension which causes resistance to keep said support cable from being unwound from said drum so that a pneumatic power tool is able to be suspended from said support cable;

(c) a sensor device which is able to remotely detect the starting and actuation of said power tool, said sensor device comprising:

(1) a cylinder having an inlet point to which a predetermined quantity of compressed air is supplied;

(2) an outlet point at an alternate end of said cylinder to which said pneumatic power tool is able to be connected by a supply hose of adaptable length;

(3) a centrally disposed outlet port within said cylinder which exhausts outside said cylinder;

(4) an array of transfer ports between said inlet point and said outlet point of sufficient size to allow free flow of said air through said cylinder but not intersecting with said outlet port;

(5) a piston contained in said cylinder which, when pressed against said outlet port, prevents said compressed air from escaping said cylinder;

(6) a spring contained in said cylinder and applying a pre-determined force against said piston to cause said piston to prevent said compressed air from escaping the cylinder;

(7) a predetermined diametrical difference between said piston and said cylinder at varying lateral positions of said cylinder to allow sufficient air flow to said power tool;

(d) a motion device actuated by said sensor device;

(e) means, including a mechanical linkage between said motion device and said drum, that will overcome and temporarily relieve said tension created by said spring;

wherein by being able to remotely detect the starting and actuation of said power tool, the sensor device is able to generate a usable air source from said outlet port for the purpose of actuating said motion device, wherein the power tool suspension mechanism with momentary tension relieving device enables suspension and support of said power tool while temporarily relieving said suspension while said power tool is operating for the purpose of greater freedom of movement and to utilize the weight of said power tool to perform work.

2. A power tool suspension mechanism with momentary tension relieving device comprising:

(a) a pair of parallel arms that are each pivotally coupled at both ends, one end of said parallel arms able to mount a pneumatic power tool;

(b) a suspension air cylinder applying a force between said parallel arms so that said power tool is able to be suspended;

(c) a sensor device which is able to remotely detect the starting and actuation of said power tool, said sensor device comprising:

(1) a cylinder having an inlet point to which a predetermined quantity of compressed air is supplied;

(2) an outlet point at an alternate end of said cylinder to which said pneumatic power tool is able to be connected by a supply hose of adaptable length;

(3) a centrally disposed outlet port within said cylinder which exhausts outside said cylinder;

(4) an array of transfer ports between said inlet point and said outlet point of sufficient size to allow free flow of said air through said cylinder but not intersecting with said outlet port;

(5) a piston contained in said cylinder which, when pressed against said outlet port, prevents said compressed air from escaping said cylinder;

(6) a spring contained in said cylinder and applying a pre-determined force against said piston to cause said piston to prevent said compressed air from escaping the cylinder;

(7) a predetermined diametrical difference between said piston and said cylinder at varying lateral positions of said cylinder to allow sufficient air flow to said power tool;

(d) an air pressure regulator acting as an exhaust valve actuated by said sensor device that will reduce pressure in said suspension air cylinder and temporarily relieve said suspension force;

wherein by being able to remotely detect the starting and actuation of said power tool, the sensor device is able to generate a usable air source from said outlet port for the purpose of actuating said air pressure regulator, wherein the power tool suspension mechanism with momentary tension relieving device enables suspension and support of said power tool while temporarily relieving said suspension while said power tool is operating for the purpose of greater freedom of movement and to utilize the weight of said power tool to perform work.

* * * * *